US006340805B1

(12) United States Patent
Ljokkoi

(10) Patent No.: US 6,340,805 B1
(45) **Date of Patent: *Jan. 22, 2002**

(54) METHOD OF MANUFACTURING A WIRE SCREEN PRODUCT

(75) Inventor: Risto Ljokkoi, Karhula (FI)

(73) Assignee: Andritz-Ahlstrom Oy, Helsinki (FI)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/077,701

(22) PCT Filed: Nov. 28, 1996

(86) PCT No.: PCT/FI96/00639

§ 371 Date: May 28, 1998

§ 102(e) Date: May 28, 1998

(87) PCT Pub. No.: WO97/20104

PCT Pub. Date: Jun. 5, 1997

(30) Foreign Application Priority Data

Nov. 28, 1995 (FI) ..... 955724

(51) Int. Cl.[7] ..... B33K 9/007; B33K 11/11; B21F 15/08; B21F 27/10

(52) U.S. Cl. ..... 219/58; 29/896.62; 140/112

(58) Field of Search ..... 428/594, 605, 428/608, 599; 210/499; 29/896.62; 166/230, 231; 140/112; 219/56, 58, 56.22

(56) References Cited

U.S. PATENT DOCUMENTS

| | | | | | |
|---|---|---|---|---|---|
| 974,891 | A | * | 11/1910 | Lachman | 219/58 |
| 1,623,055 | A | * | 4/1927 | Johnson | 219/56 |
| 1,729,197 | A | * | 9/1929 | Whann | 166/233 |
| RE18,968 | E | * | 10/1933 | Willers | 29/163.5 |
| 2,046,458 | A | * | 7/1936 | Johnson | 166/8 |
| 2,345,641 | A | * | 4/1944 | Van Sant | 219/10 |
| 2,787,452 | A | * | 4/1957 | Aghnides | 261/76 |
| 3,037,108 | A | * | 5/1962 | Poillevey | 219/56 |
| 3,101,526 | A | * | 8/1963 | Paullus et al. | 29/163.5 |
| 3,561,605 | A | * | 2/1971 | Likness | 210/497.1 |
| 3,584,685 | A | * | 6/1971 | Boyd | 166/231 |
| 3,667,615 | A | * | 6/1972 | Likness | 210/497.1 |
| 3,941,703 | A | * | 3/1976 | Binard | 210/499 |
| 4,083,090 | A | * | 4/1978 | Duvekot | |
| 4,332,862 | A | * | 6/1982 | Desmet | 428/593 |
| 4,846,971 | A | | 7/1989 | Lamort | 210/232 |
| 5,237,154 | A | | 8/1993 | Pelhammer | 219/137 R |
| 5,387,340 | A | * | 2/1995 | Ackerman | 210/497.01 |
| 5,415,294 | A | * | 5/1995 | Nagaoka | |
| 5,416,288 | A | * | 5/1995 | Widmer | |
| 5,421,084 | A | * | 6/1995 | Wolf et al. | 29/885 |
| 5,446,254 | A | * | 8/1995 | Ritter et al. | |
| 5,476,588 | A | * | 12/1995 | Nagoaka | 210/499 |

FOREIGN PATENT DOCUMENTS

| | | | |
|---|---|---|---|
| DE | 650 690 | | 9/1937 |
| DE | 42 24 727 | A1 | 2/1994 |
| JP | 57-39294 | | 3/1982 |
| JP | 61-61607 | | 3/1986 |
| JP | 405177288 | A * | 7/1993 |

* cited by examiner

*Primary Examiner*—Tom Dunn
*Assistant Examiner*—Kiley Stoner
(74) *Attorney, Agent, or Firm*—Merchant & Gould P.C.

(57) ABSTRACT

The present invention relates to a method of manufacturing a wire screen product which is especially suitable for screening fiber suspensions of the wood processing industry. It is a characteristic feature of the method according to the invention of manufacturing a wire screen product including screen wires disposed crosswire in relation to a support arranagement that includes at least one support wire, the screen wires and support wire being secured to each other such that, at the first stage, the screen wire is welded by a button spot weld to the support arrangement and, at the second stage, the screen wire is welded at another point to the same support structure.

9 Claims, 6 Drawing Sheets

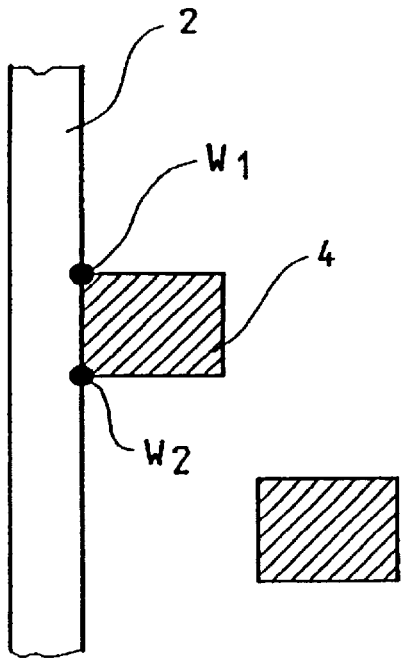
Fig. 1 – Prior Art
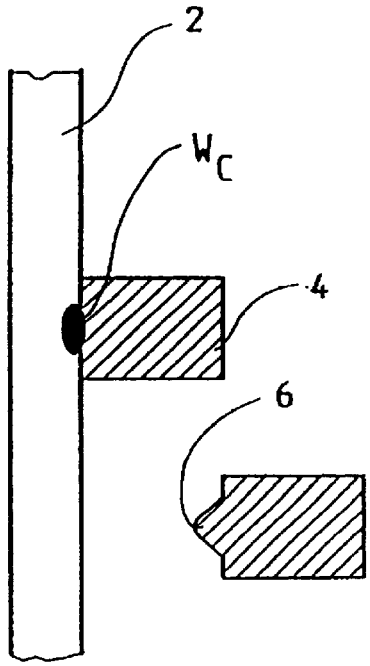
Fig. 2 – Prior Art
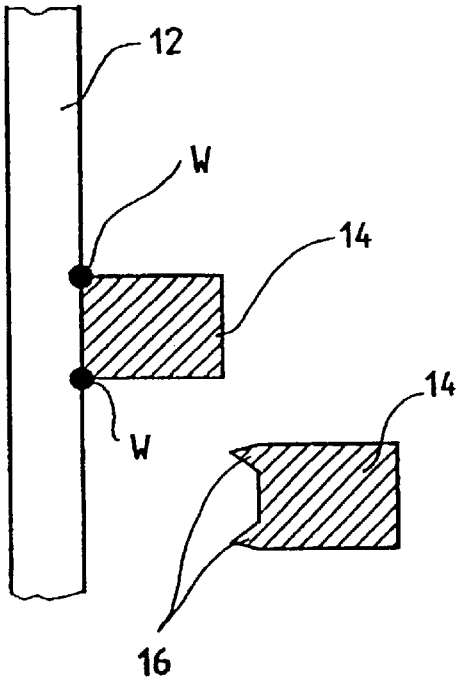
Fig. 3
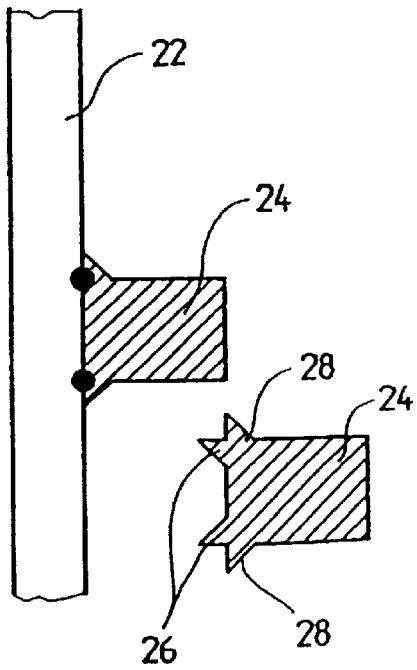
Fig. 4

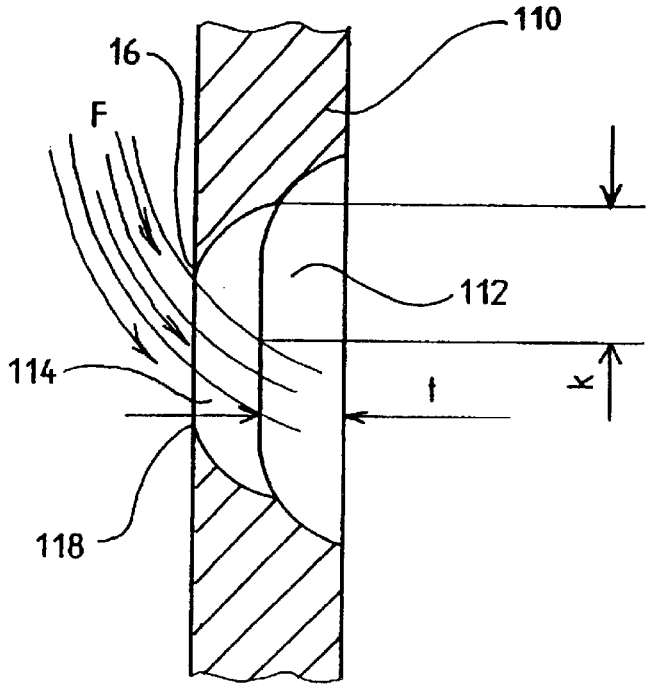
Fig. 10a – Prior Art
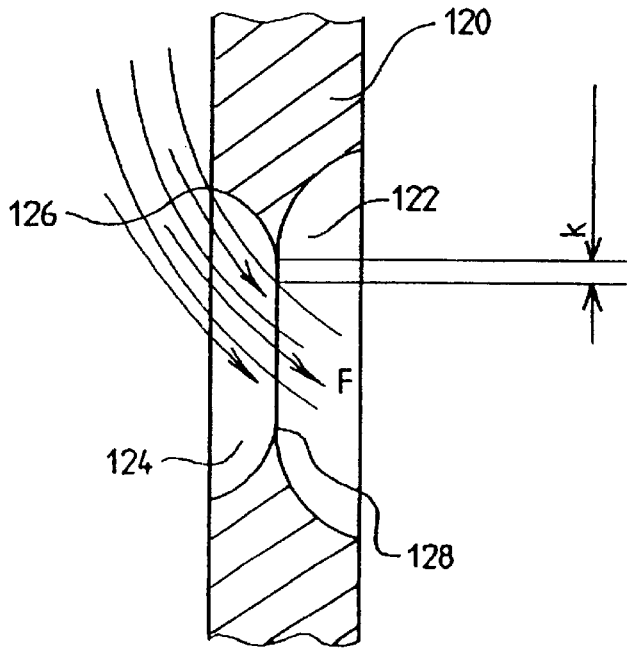
Fig. 10b – Prior Art

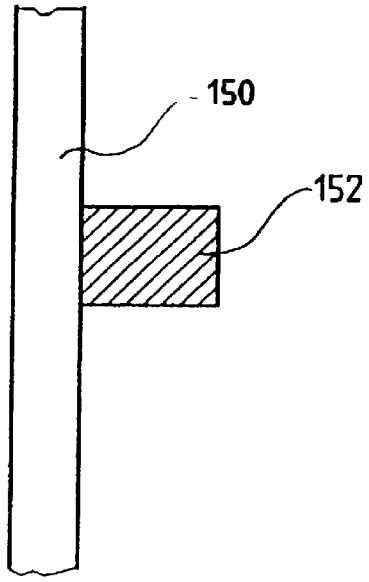
Fig. 13a – Prior Art
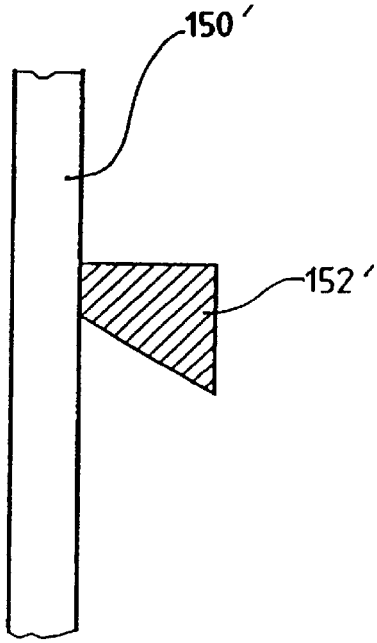
Fig. 13b
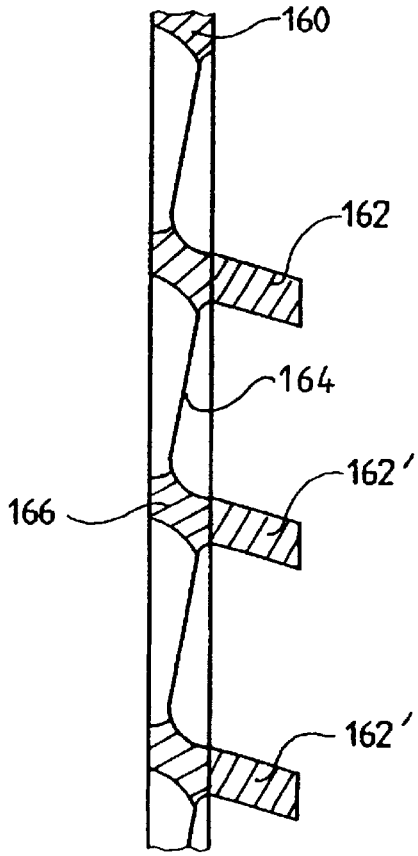
Fig. 14

METHOD OF MANUFACTURING A WIRE SCREEN PRODUCT

FIELD

The present invention relates to a method of manufacturing a wire screen product and to a wire screen product intended particularly for the screening of fiber suspensions in the wood processing industry.

BACKGROUND

The wood processing industry uses two basic types of to screening drums. One type is a drum made of a metal plate in which screen apertures, either holes or slots, have been manufactured with a desired spacing while the plate is planar after which the plate has been bent cylindrical and the edges have been welded together to form a cylinder. During the past two decades screen plates having certain kinds of grooves machined thereto before manufacture of the screen apertures have become very popular. In a finished screen drum the grooves are located parallel with the axis of the drum and the screen apertures are located at the bottom of the grooves.

The other basic type of screen drums, the so-called wire screen drums, are usually manufactured by securing support wires to a cylindrical jig onto which the screen wire is wound up with a certain pitch from a reel by rotating the jig. The screen wire supplied from the reel in secured to the support wires by welding. When a wire surface of the desired size has been formed the cylinder having the screen wires on the outer side and the support wires on the inner side is detached from the jig. After this the cylinder is cut open in its axial direction and bent to form a planar surface and further, the planar surface is bent in the opposite direction to form a cylinder so that the screen wires extend essentially in the axial direction and the support wires are parallel with the frame.

EP-A1 -0 182 688 discloses a screen drum made of wires arranged parallel to the screen drum axis and supporting rings arranged on the outflow side of the screen drum in a plane perpendicular to the screen drum axis. Both the wires and the supporting rings are provided with grooves for matching and fastening the two components together.

EP-A1-0 432 448 discusses a wire screen drum where the wires have a profiled cross-section and where the supporting rings are round of their cross-section. The wires have been fastened to the supporting rings by means of welding. For ensuring that the weld surface with its irregularities does not catch fibers passing by the weld seams have been covered by soldering.

E-650 690 discloses a screen for sorting wood chips coming from a chipper. The screening members have been fastened to each other by means of grooves substantially in a similar manner to EP-A-0 182 688.

DE-A1 - 42 24 727 discusses a screen drum having axial wires fastened to supporting rings. The wires have been secured to the supporting ring by means of pressure welding.

FIG. 1 illustrates a conventional prior art method of securing the screen wires 2 to a support wire 4. The securing is done by welding ($W_1$, $W_2$) the support wire 4 at its both sides to the screen wire 2 for example bad the MIG or TIG welding method. In practice the securing method described above has been proved to be inadequate because very often the pulses stressing the screen wires gradually fatigue the joint and thus the screen wire will gradually come off from the support wire. It should be noted that, in addition to the pulse-like radial forces, the wire is stressed also by the radial force of the rotating movement of the fiber suspension which tends to turn the screen wire around its securing point. Naturally, a failure of the welded joint results in bending of the screen wire/wires, i.e. local bulging of the screen towards the rotor which brings about a risk of the screen wires hitting the rotor and being cut which in turn destroys at least the capacity of the screen to clean pulp. In the worst case, pieces of metal detach from the wires which cause, when proceeding with the accept, unpredictable damage in subsequent pulp treatment stages, not to mention the fact that only one screen wire detached from its securing weld causes a distinct change for the worse in the purity of the accept because the size of the screening aperture has changed at the detaching point of the screen wire.

FIG. 2 illustrates a second prior art way of securing the screen wires 2 to the support wire 4. In that figures the edge 6 of the support wire facing the screen wire is sharp. This form of the support wire 4 is particularly advantageous when resistance welding is used during which the welding current malts the edge 6 and the support wire 4 is partly pressed into the back surface of the screen wire 2 producing a substantially central welding point $W_c$. It is also possible that the parts of the support wire and the screen wire to be pressed against each other are sharp, i.e. the main configuration of the cross section of both the wires is triangular whereby the edges of the wires are pressed against each other and partly inside each other during welding when the wire material fuses.

Practice has, however, shown that irrespective of the shape of screen and/or support wire, the single resistance welding point $W_c$ is not adequate to keep the wires reliably affixed to each other but in the end the wires will be detached in the same way as wires welded at sides.

On the other hand, both wire screens and screens manufactured of plates share some drawbacks. It has been known for decades that screening of cellulose pulps is based on causing the fiber suspension to be screened to rotate. This rotating movement, or rather the speed difference, is created either by rotating the fiber suspension along the screen surface by a particular rotor, or by rotating the screen drum in relation to the practically stationary fiber suspension. It is also a typical feature of the screen apparatus mentioned that the real flow direction of the suspension is axial, i.e. the suspension to be treated is supplied to the apparatus at one end of the screen drum whereby at least at the beginning of the screening process while the accept yield is the strongest the flow is predominantly axial before the rotating movement of the rotor or the drum turns the flow to resemble a spiral with a decreasing pitch. It is typical of the operation of the apparatus described above, or rather of the behavior of the suspension in the apparatus, that in most cases the flow direction of the untreated suspension approaching the screen surface is axial although the suspension in some cases is fed in tangentially but at such a low rate that the rotation velocity of either the rotor or the screen drum is clearly higher. Then, when being influenced by the rotating means of the apparatus, i.e. either the screen drum or the rotors the flow direction of the suspension turns more and more parallel with the periphery, or in practice the suspension flow assumes the shape of a spiral having a decreasing pitch towards the discharge end.

According to the old screening theory, it is essential that the screening apertures, particularly slots (when they are used) are substantially perpendicular to the flow. Also many different ways of manufacturing the above screen plate apertures are known. The apertures may have the shape of round holes or elongated blots. The manufacture of a so-called slot screen will be described here. The slots are usually manufactured by willing a plate-like basic material so that a wider so-called background groove is milled at first and after hat a narrower slot is machined through the plate in the groove either on the background groove side or on the untouched side of the plate.

The machining tool in both these stages is a narrow milling cutter giving a fairly long bevel area at the end of the groove/slot. This kind of a manufacturing method may well be used also in the manufacture of the so-called PROFILE screen plate (a design developed by A. AHLSTROM CORPORATION, today owned by CAE Screen Plates, Inc.) the surface of which facing the pulp to be treated has been provided with grooves to improve the screening efficiency of the plate. A characteristic feature of the screen plates manufactured in this way is that the narrow slot is in the apparatus itself on the side of the apparatus facing the pulp to be treated whereas the background groove is in a screen on the so-called accept side and in a thickener on the filtrate side.

Also laser cutting and so-called electron beam (cutting have recently been introduced for cutting narrow slots. By these methods the cutting is performed practically perpendicular to the surface of the plate and the background grooves are necessarily not needed.

On the other hand, the industry employs so-called wire screens in which the screen cylinder comprises a large number of adjacent wires with screen slots between them. The wires have been secured to each other in one way or another on the side opposite to the pulp to be treated. If the wires have been arranged extending substantially in the axial direction of the drum, in practice a slot having the length of the whole drums is formed which is interrupted only by the support wires or corresponding means disposed on the "backside", i.e. on the accept space side of the drum. A screen drum of this type has been found to operate remarkably well in certain conditions. For example, In plants where utmost purity of the pulp is not required but the capacity is the most important factor, wire screens of this type have proved to be excellent, particularly in the screening of dilute pulp with very narrow slots.

It has been concluded that the high capacity is due to the fact that the flow passes through the screen along the slots, in other words the flow direction remains axial and the flow drifts smoothly through the screen because there are no discontinuity spots in the screen, i.e. the slot does not seem to be interrupted at all along the whole length of the screen. Correspondingly also impurity particles have time to adopt the correct orientation to end up in the accept which reduces the purity degree of the accept.

In milled screen drums, the bracket neck between the slots which follow one another axially breaks off the flow particularly in the so-called inlet end of the screen cylinder, in which the flow still is practically axial, and thus prevents smooth flow through the screen surface. Further, also in milled drums there are dead spaces in the slots/grooves which reduce the efficient area of the slot. These factors reduce the capacity of the screen plate/drum but improve the purity of the accept obtained, because the brackets between the slots interrupt the path of the impurity particle gliding in the groove and bounce the impurity off from the vicinity of the groove and thus the impurity particle does not have time to find the right alignment to pass through the slot.

It has been noticed generally that most of the screen capacity is obtained from the top third of the dry, i.e. from the third receiving the suspension to be treated. This has been explained to result from the fact that in that portion of the drum the suspension flow is to a large extent parallel with the slots or deviates only little from it; thus, the theory presented above is confirmed. The further into the screening space the suspension proceeds, the longer time the rotor has accelerated the velocity of the suspension and the higher the velocity component of the suspension in the peripheral direction has grown. In other words, the pulp moves in the lower end or the discharge end of the drum already almost in the peripheral direction and only a small portion of the pulp fibers pass into the screen slots.

As the industry pursues to obtain as good purity and at the same time also as high capacity as possible it is desirable to try to combine the advantages and to avoid the disadvantages of both of these screens.

The object of the method and apparatus of the present invention is to overcome the difficulties in strength and precision of prior art wire screen cylinders. This object will be reached by employing both a manufacturing technique of the wire screen and a form of the support wire or the screen wire used in the manufacture which allow manufacture in two steps so that the first step comprises securing the screen wire to the support wire by button spot welding and that the second step comprises either a second button spot welding or some other welding method.

Other characteristic features of the method and the apparatus of the invention become apparent from the appended patent claims.

BRIEF DESCRIPTION OF THE DRAWINGS

The method and the apparatus of the invention are described more in detail below with reference to the accompanying drawing figures of which FIG. 1 illustrates a prior art way of securing the support wire;

FIG. 2 illustrates another prior art way of securing the support wire;

FIG. 3 illustrates a way of securing the support wire according to a preferred embodiment of the invention;

FIG. 4 illustrates a way of securing the support wire according to another preferred embodiment of the invention;

FIGS. 10*a* and 10*b* illustrate prior art screen plates cut along a screening aperture;

FIG. 13*a* illustrates a so-called prior art wire screen cut in the axial direction of the screen;

FIG. 13*b* illustrates a wire screen according to a preferred embodiment of the invention, cut in the axial direction of the screen; and FIG. 14 illustrates, in section, a way of supporting a screen cylinder according to a preferred embodiment of the invention.

DETAILED DESCRIPTION

Figure 5:
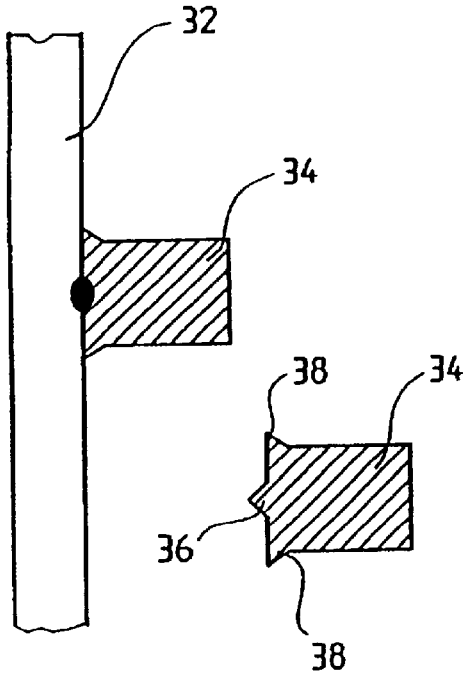
FIG. 5 illustrates a way of securing the support wire according to a third preferred embodiment of the invention.

In connection with FIGS. 1–8, the cross section of the support wire used in the figure itself has been illustrated in the right lower corner of the figure.

FIG. 3 illustrates a securing method in which two longitudinal ridges 16 have been arranged in a support wire 14 so that when a screen wire 12 is pressed with an electrode disc used in resistance welding against a support wire 14 in a jig, one of the ridges 16 touches first the screen wire 12 and the other one only after that. This produces in each screen wire 12 two welding points W at a distance from each other which, however, may be combined at large welding currents. The screen wire 12 secured by the method illustrated in the figure is essentially more firmly secured to the support wire 14 than a wire secured by the methods of FIGS. 1 and 2.

FIG. 4 illustrates a version which has been developed further from the embodiment of FIG. 3 and in which the support wire 24 has been provided at least at its one side by a bracket 28 mainly to ensure that the support wire 24 and the screen wire 22 are not pressed during the welding one inside the other more than just as much as is desired. The use of this kind of brackets 28 is particularly preferable when the support wire 24 and the screen wire 22 are relatively thin and have sharp edges whereby even slight changes in the welding current or in the weight of the electrode would result in the wires being pressed too deep into each other. In other words, the brackets 28 ensure more reliably than before the precision of the screen drum to be manufactured. A second reason for employing brackets 28 is to use them to prevent flashes of resistance welding, which would impede the screening process, from being formed beside the support wire 24. A third reason for using brackets 28 may be, if desired, to provide base material for additional welding beside the support wire 24; the welding may be carried out as MIG or TIG welding or, for example, as resistance welding.

FIG. 5 illustrates an embodiment in which the support wire 34 has been provided with a bracket 38 at least in one side thereof (in the figure in both sides) for the same reasons as in the previous embodiment. However, particularly in this embodiment it is advantageous to weld the support wire 34 at least at its one side, preferably at both sides, by means of the bracket 38 to the screen wire 32. An advantage provided by the bracket 38 compared with the method illustrated for example in FIG. 1 of welding the support wire only at its rectangular sides, is that the supporting points of the screen wire 32 on the support wire 34 are remarkably further apart from each other and thus the securing between them is remarkably firmer than before.

Figure 6:
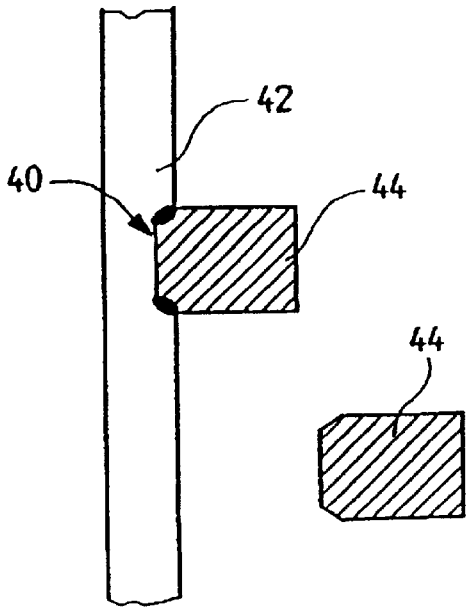
FIG. 6 illustrates a way of securing the support wire according to a fourth preferred embodiment of the invention.

FIG. 6 illustrates yet another preferred embodiment of the invention, in which a recess 40 has been made in a screen wire 42 for a support wire 44. The idea is that while the screen wire 42 is being welded to the support wire 44 the first edge of the recess 40 of the screen wire 42 is first pressed against the support wire 44 and is welded thereto. After that the second edge of the screen wire 42 recess 40 is pressed against the support wire 44 and is welded thereto. By means of the screen wire 42 recesses 40 spaced evenly apart the wire and the support wire may be placed exactly face to face and thus further improve the dimensional accuracy of the product.

Figure 7:
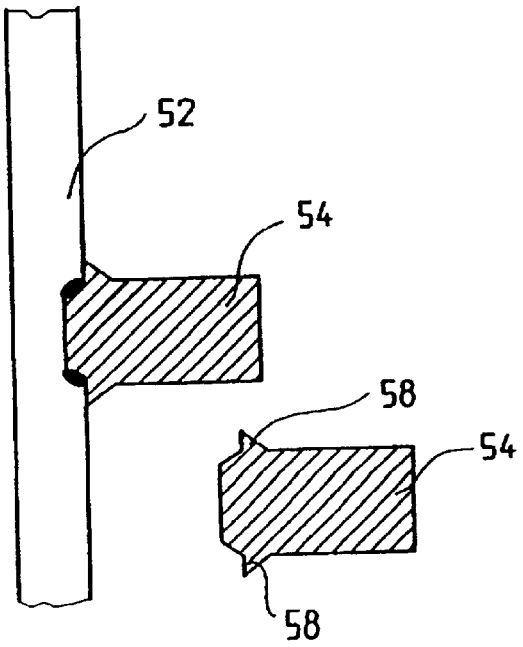
FIG. 7 illustrates a way of securing the support wire according to a fifth preferred embodiment of the invention.

FIG. 7 illustrates, with reference to the basic structure of FIG. 6, a version of the support wire 54 developed further, in which the brackets 58 of the support wire 54 are used to ensure that the screen wire 52 and the support wire 54 are pressed into, each other the way desired.

Figure 8:
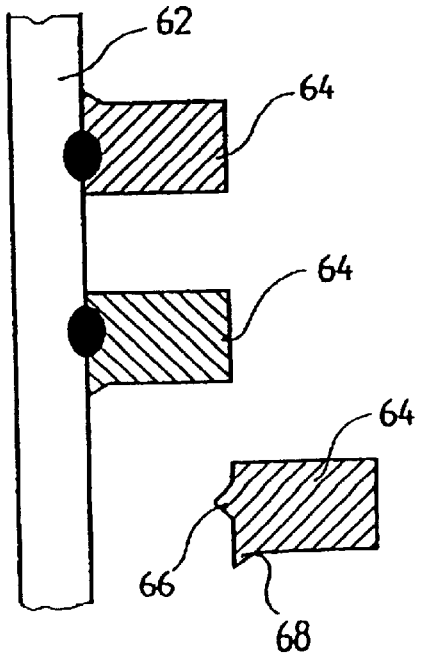
FIG. 8 illustrates a way of securing the support wire according to a sixth preferred embodiment of the invention.

FIG. 8 illustrates yet another alternative way of arranging the securing of the screen wires 62 very sturdy. In the embodiment of the figure, instead of using one support wire, a so-called support arrangement has been provided in which two support wires 64 have been disposed very close to each other, possibly even side by wide touching each other. The support wire 64 may be of any of the types described above or their modifications although particularly advantageous are the types illustrated in FIGS. 4 and 5 but possibly without the bracket on one side.

Since support wires are provided in wire screen drums typically about 15–50 mm apart from each other it is essential in the embodiment of FIG. 8 that the distance between the two adjacent support wires of a support arrangement is at the most 10–15% of the distance between the adjacent support arrangements in other words the distance is at the most of the order of 5–10 mm.

No dimensions of the screen wires or the support wires have been presented in connection with the above figures. Since the invention relates mainly to the securing and form of the support wire specifically in the area where the screen wire and the support wire are secured to each other, the dimensions of the screen wire are not of that significant importance that that would have to be mentioned. The support wires are typically in most cases rectangular in cross section so that the dimension in the axial direction of the drum is of the order of 3–10 mm and the dimension in the radial direction is of the order of 5–30 mm. Thus for example with the support wires illustrated in FIGS. 3 and 4, the welding points are almost ten millimetres apart from each other when a broad support wire is used .

Of course it is not necessary to have two welding points with a 3 mm wire as with a thin wire one welding point extends in practice over the whole width of the wire. However, it should be noted that the embodiments of the invention presented above cover all different cross section forms of the support wire because the embodiments mentioned relate only to the structure and form of the securing area of the support wire.

Figure 9:
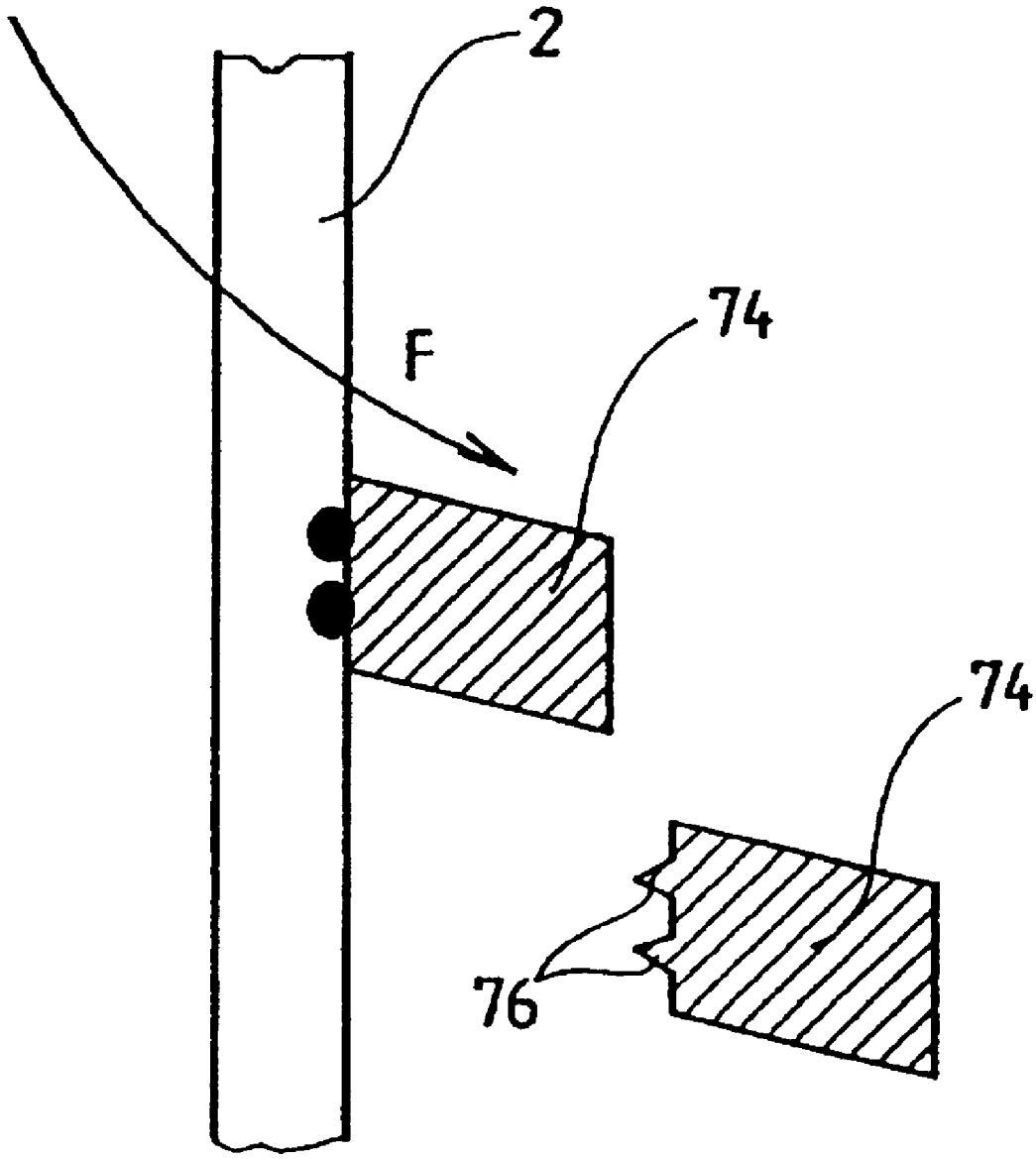
FIG. 9 illustrates a support wire according to a preferred embodiment of the invention, secured to a screen wire.

FIG. 9 illustrates yet another alternative embodiment of the invention the only difference of which compared to the embodiments described above is the cross sectional form of the support wire 74 which in this embodiment has been optimized according to the flow direction of the accept flow through the screen apertures. In other words, the cross sectional form of the support wire 74 (in this embodiment presented as an example, only) is a parallelogram disposed so that it resists the flow through the screen drum as little as possible; the flow direction is depicted by an arrow F. As may be understood from the above, according to the present screening theory the acceptance of the fibers is considered to take place at least partly from the flow parallel with the screening slot; thus the support wires have been inclined from their free (not secured) edge towards the discharge end of the screen cylinder at least more than 5 degrees, preferably 15 degrees. Also it is possible to provide support wires the cross section of which shows that the side surface of the support wire facing the inlet end of the screen cylinder has been inclined towards the discharge end of the screen cylinder. (The inlet end means here the end of the screen and also of the screen cylinder via which the material to be treated is supplied into the apparatus. Correspondingly, the discharge end means the opposite end of the screen via which, at least in conventional apparatus, the screened pulp or the accept and the coarse fraction or the reject are discharged from the screen.) On the other hand the present screening theory mentioned above supports the idea that the screening slots should preferably be arranged almost parallel with the spiral flow of the fiber suspension and by no means perpendicularly against the spiral flow. In practice this could be done by composing a screen cylinder of a number of relatively short cylinders so that the angle of incline of the screen slots relative to the axial direction increases from the inlet and towards the discharge end, i.e. corresponding to the change of suspension flow direction from the initially more or less axial direction to more and more peripheral. Of course all the support wire forms and securing means described above, also the ones illustrated in FIGS. 1 and 2, as regards the securing of the support wire and the screen wire, i.e. ridges and brackets, may be applied also in this embodiment the main objective of which is not a maximal strength of the screen drum but a minimized flow resistance over the screen drum.

The screen plate illustrated in FIG. 10*a* has been manufactured in a conventional way by milling so that at first a background groove 112 has been machined to a certain depth t in a plate material 110 and subsequently the screening aperture 114 itself from the same side of the screen plate; in other words the whole machining operation takes place on the accept space side of the finished screen plate. The figure illustrates how a large dead space k in the screening aperture 114 remains on the side 116 receiving the flow F, i.e. how much shorter than the background groove 112 the efficient length of the screening aperture 114 is. If the flow is supposed to arrive along the surf ace of the plate substantially parallel with the slot 114 the leading edge of the aperture 114, i.e. the upstream edge 116 of the slot 114, covers a major part of the length of the inner portion of the slot, i.e. of the area of the slot. It should, however, be noticed that the downstream edge 118 of the slot 114, although it extends seen from the perpendicular direction, or, in other words from above, over the slot 114, does not in any way hinder the suspension flow arriving along the surface of the plate 110 from flowing into the slot 114.

The screen plate 120 illustrated in FIG. 10*b* has been manufactured in a corresponding way by milling but the screening slot 124 has been made on the opposite side of the plate compared to the background groove 122. In this embodiment the leading edge 126 of the screening slot 124 allows better the flow to enter the slot 124 but the downstream edge 128 of the slot 124 extends unnecessarily too far because the flow hits perpendicularly the edge 128 of the aperture and thus cannot proceed smoothly to the background groove 122. The dead space k is remarkably shorter than in the embodiment of FIG. 10*a* but clearly longer than needed as may be seen from the following embodiments of the present invention.

The invention may be approached also in quite another way. The relationship of the open area and/or the capacity of the screen plate to the strength of the plate may be considered. As is generally known the weakest point of the screen plate is at the slots because the plate portion or the neck between the slots must bear all the stress directed to the plate. FIGS. 10*a* and 10*b* indicate that all the material removed from the dead space both in the background groove and at the end of the screening slot receiving the flow has been unnecessarily removed and thus reduces the strength of the plate. Because of the strength of the plate, the neck between the slots must have a certain amount of material, the material removed from the slots must be replaces by increasing the length of the portion remaining between two adjacent slots. Thus, by optimizing the shape of the neck portion a remarkably better ratio of the length of slot/the length of neck is obtained which naturally results almost directly in the capacity of the screen plate.

Figure 11:
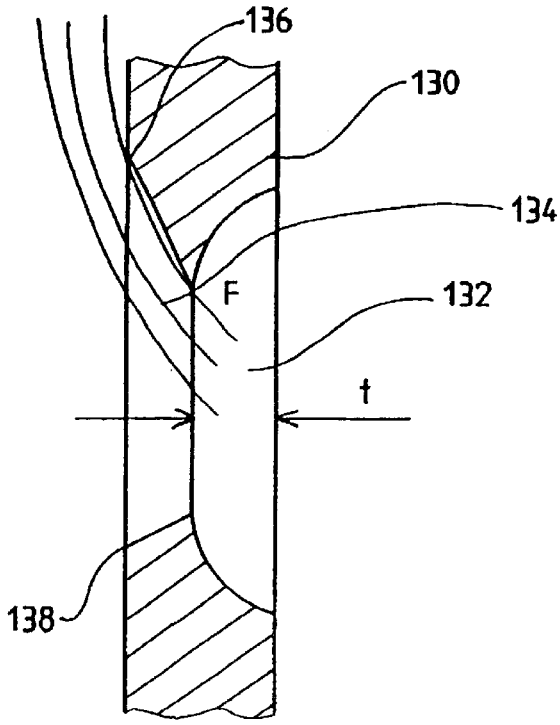
FIG. 11 illustrates a screen plate according to a preferred embodiment of the invention, cut along a screening aperture.

FIG. 11 illustrates a screen plate structure according to a preferred embodiment of the invention, in which a background groove 132 (which in this embodiment is not necessarily needed) extending to a depth t has been machined to a plate 130 in a conventional way but the screening slot 134 has been machined so that the upstream edge 136 of the slot 134 has been inclined towards the incoming direction of the flow F so that the flow has as easy access to the slot 134 as possible. Correspondingly also the downstream edge 138 of the slot 134 has been inclined towards the incoming flow direction because it is unnecessary to extend the slot further than this as the slot would not be able to efficiently receive the flow. The essential factor for the screen plate itself is, however, that between two successive slots there is in the longitudinal direction of the slots an unperforated area or neck of a certain size which provides the desired strength of the plate. In other words this unperforated plate portion or neck keeps the plate together in real stress situations. By optimizing the form of the neck so that the inclination of the end of the slot has been adjusted according to the flow velocity of the pulp to be treated, the efficient length of the slot may be remarkably increased. In practice the efficient length of the screening slot is directly proportional to the capacity of the screen plate. The only practical problem with the screen plate described is the modern manufacturing technique it requires, i.e. the screening slots must be manufactured either with a laser, an electron beam or some other corresponding method.

Figure 12:
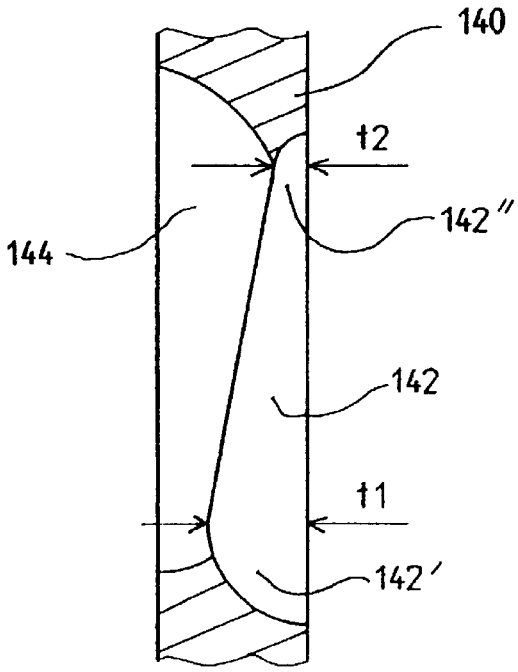
FIG. 12 illustrates a screen plate according to another preferred embodiment of the invention, cut along a screening aperture.

FIG. 12 illustrates another method giving nearly as good results, of manufacturing a screen plate 140 which is also suitable to be manufactured by conventional methods, i.e. by milling. An asymmetric background groove 142 has been machined in a plate 140, the groove extending at its downstream edge 142' to a depth t1 and at its upstream edge 142" to a depth t2 whereby t1>t2. A screening slot 144 is milled to the background groove 142 on the opposite side of that plate in the way illustrated in the figure so that the efficient length of the screening slot 144 is as long as possible. In fact the screen plate illustrated in FIG. 12 is even a little stronger than conventional structures due to the asymmetric milling of the background groove 142 resulting in a better material strength along the most part of the length of the screening slot than in conventional screen plates. It is easy to provide the neck between the slots as strong as or even stronger than in prior art plates although the length of slot/length of neck ratio is improved.

FIG. 13*a* illustrates an ordinary prior art wire screen structure in which the wires 150 arranged in the longitudinal direction of the drum have been supported at the back by bands 152 disposed substantially in the peripheral direction of the drum, their conventional cross sectional shape being a rectangle. A drawback of this structure as well an of other conventional milled screen plates is the asymmetry of the ends of the slots which results in that the whole length of the slot is not efficiently in use.

FIG. 13*b* illustrates an improved wire screen in which the wires 150 have been secured to asymmetric bands having a triangular cross section, or more broadly expressed in brackets, so that the flow through the plate is disturbed as little as possible. The downstream edge of the band mentioned has been bevelled so that it does not prevent the flow from turning smoothly into the slot while providing the bands with an adequate area to ensure their strength.

The securing of wires of a wire screen may be done also for example by welding a run on the wires in their transverse direction facing the side on which the pulp to be screened is, or by affixing the supporting ring on the accept space side in its place in this way.

The neck solution for a screen plate according to the invention described above may be applied in addition to the smooth screen plates and the so-called wire screens described above also in the so-called PROFILE screens in which grooves have been machined in the plate surface facing the pulp to be screened. Usually these grooves provide a base for the screening slots and thus the slots and the grooves are parallel as the slots are located in the bottom of the grooves. Now it has ben discovered that by applying the structure of the present invention, the slots need not be located in the grooves mentioned, but they may be disposed at an angle in relation to each other.

In a way corresponding to the one described in connection with the previous figures, also the support bands 162 of a screen plate 160 (FIG. 14) manufactured of a conventional plate may be optimized, the bands usually having a cross-sectional configuration of a rectangle and being located at the "backside" of the plates described in FIGS. 10–12 on the neck 166 between the sots 164. Also these bands 162 hinder the flow from proceeding smoothly through the slots 164; thus it is advantageous to make the bands 162' asymmetric so that the side of the band 162' at the trailing edge of each slot 164 has been strongly bevelled. In a corresponding way also the edge of the band 162' on the opposite side of the slot 164 may be bevelled as it does not hinder the flow at all.

The same solution according to the invention also removes the problem of purity occurring in wire screens, i.e. their feature of allowing more impurities to pass through more than slots screens do. By arranging the brackets between the wires so far (on the side facing the pulp to be screened) between the wires that they prevent the impurity particles from gliding along the slots, the impurities are guided to the pulp to be screened whereby they have smaller chances of getting into the accept. Further, the slots between the wires may be punched together at certain intervals on the side of a finished wire screen facing the pulp to be screened so as to bounce the impurity particles off from the slot before they are drifted through the slot.

As may be understood from the above, remarkably larger open effective area and thus improved capacity without impairing the quality of the end product may be obtained by means of the embodiments of the present invention presented above compared to prior art screens and/or thickeners. Further, as also may be understood from the above, a method of new type has been developed of securing the screen wire support wires and the screen wires to each other. According to the invention the wire screen drum becomes sturdier and more reliable. With reference to what has been presented above it should be born in mind that only a few preferred embodiments of the invention have been described which in no way limit the scope of the invention from the one defined by the appended patent claims. Thus, although longitudinal ridges of the support wire have been discussed in connection with the support wire, a continuous ridge is only one preferred embodiment of the invention. Another alternative is to provide a row of protrusions in the longitudinal direction of the wire and to weld the wire at these to the screen wire. Thus, the term "ridge" also covers a row of protrusions in the longitudinal direction of the support wire, the protrusions being used for securing the screen wire to the support wire. In a corresponding way, the projecting parts by the side of the support wire may be continuous extending along the whole length of the support wire or they may be discontinuous, only knobs at the screen wire.

What is claimed is:

1. A method of producing a wire screen product, the wire screen product including at least one screen wire and at least one support wire that transversely crosses the screen wire, the support wire including a first ridge and a second ridge, the method comprising:

contacting the screen wire and the first ridge of the support wire at a location where the screen wire and the support wire transversely cross;

welding the screen wire to the support wire at the first ridge using a first weld; and thereafter contacting the screen wire and the second ridge of the support wire at the location where the screen wire and the support wire transversely cross, and welding the screen wire to the support wire at the second ridge using a second weld.

2. The method according to claim 1, wherein the first weld is spaced from the second weld.

3. The method according to claim 1, wherein welding the screen wire to the support wire at the first ridge occurs adjacent a center line of the support wire.

4. The method according to claim 1, wherein contacting the screen wire and the first ridge of the support wire occurs on one side of a center line of the support wire.

5. The method according to claim 4, wherein contacting the screen wire and the second ridge of the support wire occurs on an opposite side of the center line of the support wire.

6. The method according to claim 1, wherein the first ridge forms the first weld, and the second ridge forms the second weld.

7. The method according to claim 1, wherein the welding comprises resistance welding.

8. A method of producing a wire screen product, the wire screen product including at least one screen wire having a recess and at least one support wire that transversely crosses the screen wire, the method comprising:

contacting the screen wire and a first portion of the support wire at a location where the screen wire and the support wire transversely cross by inserting the support wire into the recess and contacting an edge of the recess with the first portion of the support wire;

welding the screen wire to the support wire at the first contact portion using a first weld; and thereafter contacting an opposite edge of the recess with a second portion of the support wire, and welding the screen wire to the support wire at the second contact portion using a second weld.

9. A method of producing a wire screen product formed from screen wires and support wires that transversely cross the screen wires, the support wires including first and second spaced ridges, comprising:

contacting one of the screen wires and the first ridge of one of the support wires at a location where the one screen wire and the one support wire transversely cross;

welding the one screen wire to the one support wire at the point of contact between the one screen wire and the first ridge of the one support wire;

thereafter contacting the one screen wire and the second ridge of the one support wire at the location where the one screen wire and the one support wire transversely cross; and welding the one screen wire to the one support wire at the point of contact between the one screen wire and the second ridge of the one support wire.

* * * * *